US007232122B2

(12) United States Patent
Mayer et al.

(10) Patent No.: US 7,232,122 B2
(45) Date of Patent: Jun. 19, 2007

(54) JAM DETECTION METHOD AND SYSTEM FOR AN INSERTER

(75) Inventors: Paul Mayer, Middlebury, CT (US); Thomas Rosenkranz, Dover Plains, NY (US); Andrew Nikolatos, Brewster, NY (US)

(73) Assignee: Pitney Bowes Inc., Stamford, CT (US)

( * ) Notice: Subject to any disclaimer, the term of this patent is extended or adjusted under 35 U.S.C. 154(b) by 879 days.

(21) Appl. No.: 10/388,683

(22) Filed: Mar. 14, 2003

(65) Prior Publication Data

US 2004/0178555 A1 Sep. 16, 2004

(51) Int. Cl.
*B65H 5/22* (2006.01)

(52) U.S. Cl. ..... 271/4.01; 270/52.16; 270/52.14; 270/58.29; 270/58.03; 271/3.18; 271/176

(58) Field of Classification Search ..... 358/498; 271/259, 3.18, 4.01, 176; 270/58, 52.16, 270/52.14, 58.29; 399/21, 361, 367
See application file for complete search history.

(56) References Cited

U.S. PATENT DOCUMENTS 2,427,839 A * 9/1947 Davidson ..... 270/58.29
4,338,671 A * 7/1982 Korytkowski et al. ..... 700/213
4,560,293 A * 12/1985 McCumber et al. ..... 400/61
4,972,655 A * 11/1990 Ogawa ..... 53/155
5,323,219 A * 6/1994 Hamanaka et al. ..... 399/371
5,358,235 A * 10/1994 Konno et al. ..... 271/227
5,564,845 A * 10/1996 Yamaguchi et al. ..... 400/582
5,641,158 A * 6/1997 Gelb et al. ..... 271/225
5,734,566 A * 3/1998 Stengl ..... 700/9
5,754,434 A * 5/1998 Delfer et al. ..... 700/223
5,779,378 A * 7/1998 Kikuchi ..... 400/616.2
5,839,046 A * 11/1998 Takano et al. ..... 399/384
5,893,021 A * 4/1999 Yanashima ..... 399/384
5,929,894 A * 7/1999 Kikuchi ..... 347/262
6,328,297 B1 * 12/2001 Antonelli et al. ..... 270/52.16
6,361,036 B1 * 3/2002 Nakazawa ..... 270/58.07

(Continued)

FOREIGN PATENT DOCUMENTS

DE 60007690 E * 2/2004

(Continued)

*Primary Examiner*—Aung S. Moe
*Assistant Examiner*—Chad Dickerson
(74) *Attorney, Agent, or Firm*—Michael J. Cummings; Steven J. Shapiro; Angelo N. Chaclas

(57) ABSTRACT

A document assembly system with jam detection capability. The system including an accumulation chassis having a series of pusher fingers for pushing collations of documents. Above the chassis, document feeders release documents to the chassis to form the collations. A set of horizontal photo-sensors is positioned below the document feeder at a level substantially even with the tops of the pusher fingers on the chassis. The photo-sensors detect lead and trail edges of documents traveling in the flight path from the document feeder to the chassis. The sensors generate signals representing the lead and tail edges of documents breaking the line between the photo-sensors. A controller receives the signals from the photo-sensors and compares them to an expected profile calculated as a function the parameters of operation for the chassis and feeders. An error signal is generated when the compared signals are different from the expected profile by greater than a predetermined margin of error.

6 Claims, 3 Drawing Sheets

U.S. PATENT DOCUMENTS 6,367,794 B1 * 4/2002 Godwin et al. ..... 270/58.26
6,449,020 B1 * 9/2002 Salle et al. ..... 348/645
6,601,364 B2 * 8/2003 Sussmeier ..... 53/52
6,607,190 B1 * 8/2003 Guiles et al. ..... 271/4.03
6,783,290 B2 * 8/2004 Sussmeier ..... 400/608.4
6,826,445 B2 * 11/2004 DiNapoli et al. ..... 700/223
2003/0097821 A1 * 5/2003 Sussmeier ..... 53/460

FOREIGN PATENT DOCUMENTS

EP 1097889 A2 * 5/2001
EP 1306336 B1 * 5/2006

* cited by examiner

JAM DETECTION METHOD AND SYSTEM FOR AN INSERTER

TECHNICAL FIELD

The present invention relates to an improved jam detection system for use in connection with feeders feeding documents onto a document accumulation chassis in a high speed mass mail processing and inserting system.

BACKGROUND OF THE INVENTION

Inserter systems, such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and APS™ inserter systems available from Pitney Bowes Inc. of Stamford Conn.

In many respects, the typical inserter system resembles a manufacturing assembly line. Sheets and other raw materials (other sheets, enclosures, and envelopes) enter the inserter system as inputs. The modules and workstations of the inserter system work cooperatively to process the sheets until a finished mail piece is produced. The exact configuration of each inserter system depends upon the needs of the particular customer or installation.

Typically, inserter systems prepare mail pieces by gathering collations of documents on a conveyor chassis. Insert feeders above the chassis release inserts, such as special offers or advertisements, onto the collations as they pass underneath on the chassis. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

The stages of a typical inserter system are depicted in FIG. 1. At the input end of the inserter system, rolls or stacks of continuous printed documents, called a "web," are fed into the inserter system by a web feeder 10. The continuous web must be separated into individual document pages. This separation is typically carried out by a web cutter 20 that cuts the continuous web into individual document pages. Downstream of the web cutter 20, a right angle turn 30 may be used to reorient the documents, and/or to meet the inserter user's floor space requirements.

The separated documents must subsequently be grouped into collations corresponding to the multi-page documents to be included in individual mail pieces. This gathering of related document pages occurs in the accumulator module 40 where individual pages are stacked on top of one another. Downstream of the accumulator 40, a folder 50 typically folds the accumulation of documents, so that they will fit in the desired envelopes. Then, a buffer transport 60 transports and stores accumulated and folded documents in series in preparation for transferring the documents to the synchronous inserter chassis 70.

On the chassis 70 collations of documents received from the buffer 60 are pushed in the downstream direction by regularly spaced pusher fingers. Typically, document feeders positioned above the chassis and pusher fingers will release additional documents to be included in the collation. Such additional documents are often referred to as inserts and may be special offers or advertisements to be included with a customer's billing statement. To verify that inserts are being properly fed from the document feeders, it is known to position a set of diagonally oriented photo-sensors orthogonal to the feed path of inserts. Such diagonal photo-sensors are typically immediately below the feeders to verify that documents are being fed as expected. Such feeder sensors detect lead and trail edges of documents and confirm that documents are fed onto accumulations as expected.

Downstream of the chassis 70 and insert feeders, the final collations are stuffed into envelopes at insert station 80 and the appropriate postage markings may be added. Finally, the finished mail pieces are sorted by an output sorter 90 to comply with postal requirements for receiving postage discounts.

In an inserter system such as the one shown in FIG. 1 it is desirable that misfed documents and paper jams be detected. One reason is that accurate creation of mail pieces is of importance to users of inserter systems. Another reason is that continued operation during a jam condition can result in the further damaging of mail pieces.

For this purpose, it is known to include a mechanical jam detection device in the chassis 70. This mechanical jam detection device is typically a movable switch positioned above the chassis deck. If paper transported along the chassis deck is prevented from moving, it will usually buckle and crumple in an upward direction. Such buckling will move the mechanical switch suspended above the chassis and a jam signal will be generated. Such a mechanical jam detection switch is sometimes referred to as a jam wire. A disadvantage of mechanical jam detection switches is that they require physical contact with buckling mail pieces. As such, damage may be caused to the buckled document.

SUMMARY OF THE INVENTION

The present invention represents an improvement over the prior art in that a non-destructive jam detection system is introduced for use with the inserter chassis, and to provide monitoring of the proper formation of document accumulations.

In accordance with these objectives, the present invention is a document assembly system with jam detection capability. The system includes an accumulation chassis having a series of pusher fingers for pushing consecutive collations of documents in a downstream direction. Above the chassis, document feeders release documents to the chassis to form the collations. The document feeders are oriented to release documents in a diagonal flight path. The timing and speed of the feeders are functions of the chassis speed and position to coordinate the proper formation of collations as they pass below the feeders.

A set of horizontal photo-sensors is positioned below the document feeder at a level substantially even with the tops of the pusher fingers on the chassis. The photo-sensors detect lead and trail edges of documents traveling in the flight path from the document feeder to the chassis. The sensors generate signals representing the lead and tail edges of documents breaking the line between the photo-sensors.

A controller receives the signals from the photo-sensors. The controller also calculates an expected profile of lead and tail edge signals from the photo-sensors as a function of the parameters of operation for the chassis and feeders. These parameters include the length of the documents, the speed of the document feeder, and a predetermined cycle for feeding documents. The controller compares the expected profile with the signals from the set of photo-sensors and generates an error signal when the signals are different from the expected profile by greater than a predetermined margin of error. Thus, for example, if no signal was received to indicate that a lead edge of an insert had crossed plane of the photo-sensors, then an error signal could indicate that the insert did not make it to the intended portion of the chassis. In another example, if the beam between the photo-sensors is blocked for too long without detecting a tail edge, then it can be determined that jam condition, or a condition where an insert is improperly on top of the pusher fingers, exists.

Further details of the present invention are provided in the accompanying drawings, detailed description and claims.

DETAILED DESCRIPTION

Figure 2:
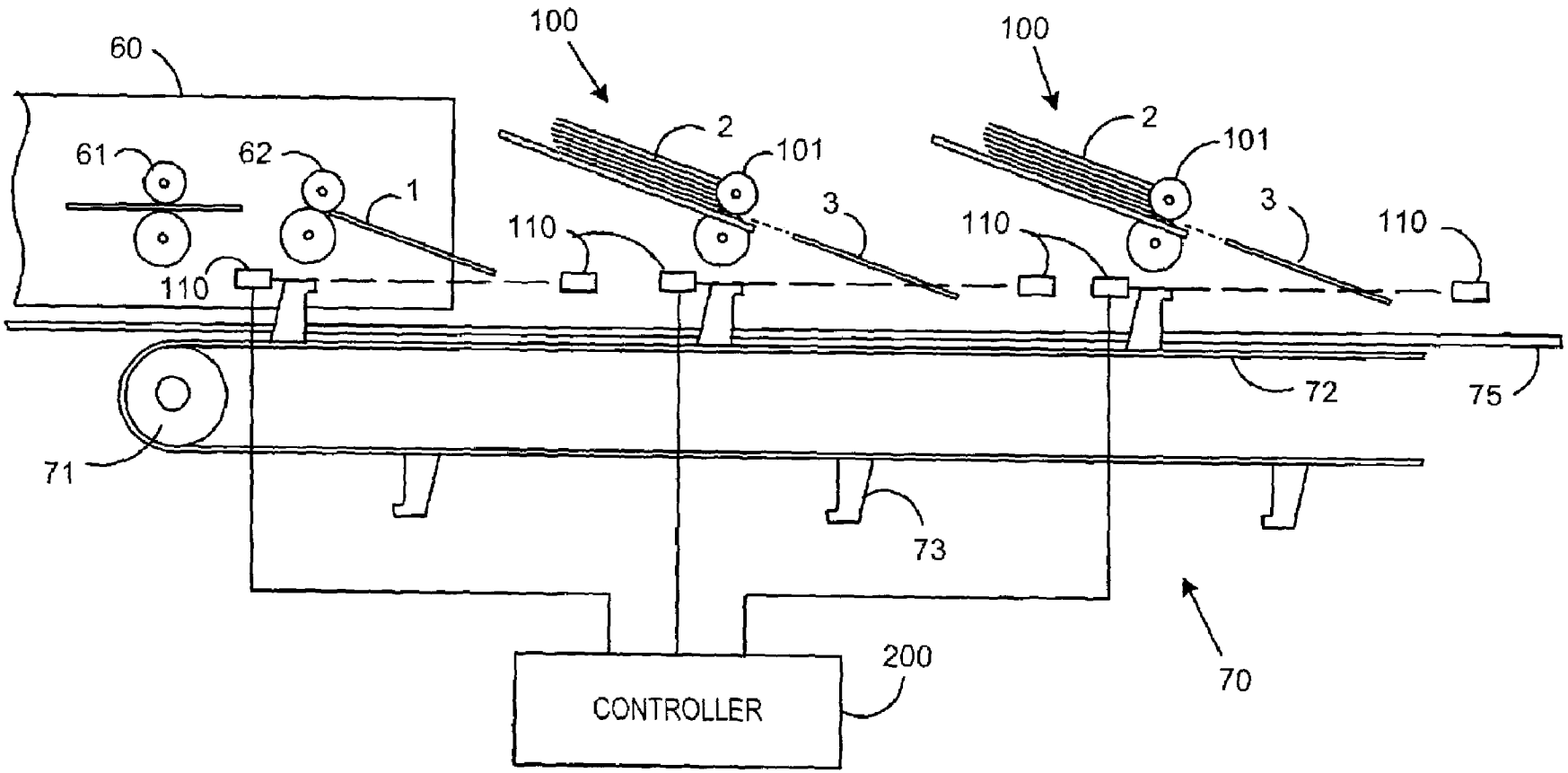
FIG. 2 depicts a chassis and feeder arrangement in accordance with the present invention.

A preferred embodiment for implementing the present invention is depicted in FIG. 2. In this embodiment a buffer 60 synchronously feeds collations 1 of documents onto the synchronous inserter chassis 70. Within the buffer 60 documents are fed by buffer nips 61 and transferred to the chassis via the end nips 62. The discharge of collations 1 from the buffer 60 is synchronized with the position of the inserter chassis.

Collations released onto the chassis 70 land on a deck 75. Sets of pusher fingers 73 protrude through slots in deck 75. These pusher fingers 73 are mounted on continuous chains 72 that are driven by roller 71. Thus the pusher fingers 73 are moved in the downstream direction, and act upon the collation 1 and push it in the downstream direction.

As documents are pushed down the chassis deck 75 they pass beneath insert feeders 100. For purposes of this application, feeders may refer to any insert feeder, transport, buffer, check feeder or any device that places an insert with an accumulation on the chassis 70. These insert feeders 100 are synchronized with the chassis 70 to release inserts 3 when the chassis reaches predetermined locations. Inserts 3 (or a document) may be one or more documents, business cards, CD, or other item to be included in a mail piece. Feeder rollers 101 feed inserts 3 from a stack 2. Inserts 3 fed from the feeders 100 will land on top of a collation 1 arriving from upstream, and the combined collation will be pushed by the pusher fingers further downstream to receive further inserts, or for further processing.

The insert feeders 100 are controlled to provide inserts 3 to as many or few of the collations that require them. For example, for a given mail run, only selected recipients may receive a particular advertisement insert. Accordingly, the insert feeder 100 is controlled to release advertisement inserts only for those collations passing underneath for which the advertisement is desired.

Figure 1:
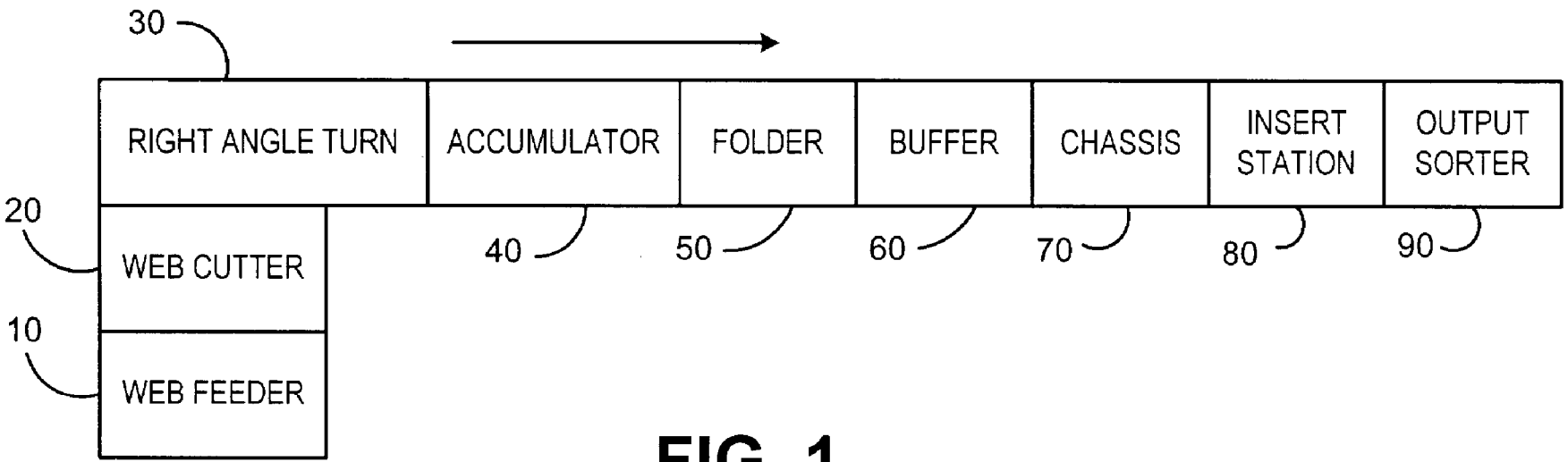
FIG. 1 is a diagram of the input stages of an inserter system for use with the present invention.

In accordance with the preferred implementation of the present invention, horizontal pairs of photo-sensors 110 are positioned below each of the feeders 100 and at the input location from the buffer 60. The horizontal positioning of the sensors 110 is intended to include any arrangement in which the sensors are positioned substantially parallel to the chassis deck 75 below. Sensors 110 may be any kind of photocells, but are preferably pairs comprising both a transmitter and a receiver. The photo-sensors 110 are preferably positioned at the level of the top of the pusher fingers 73. At that position the sensors 110 are best suited for detecting whether documents are improperly overlapping from one accumulation zone to another. Like the diagonally positioned photo-sensors known from the prior art, these sensors may detect the passage of inserts 3 onto the chassis 70 to confirm the proper formation of accumulations 1. However, the arrangement depicted in FIG. 1, along with modification to the electronic controls for interpreting the sensor information, allow the sensor to additionally serve as detectors of documents that are out of position on the chassis 70. Such sensed documents are potentially jammed, or likely to cause a jam.

Sensor pairs 110 are coupled to controller 200 and provide signals indicating leading and trail edges of documents.

To facilitate the photo-sensors 110 use as a jam condition detector, the controller 200 calculates an expected sensor input based on what would be expected for normal operation under the operating conditions. An exemplary calculated profile from sensors 110 is depicted in FIG. 3*a*.

Figure 3A:
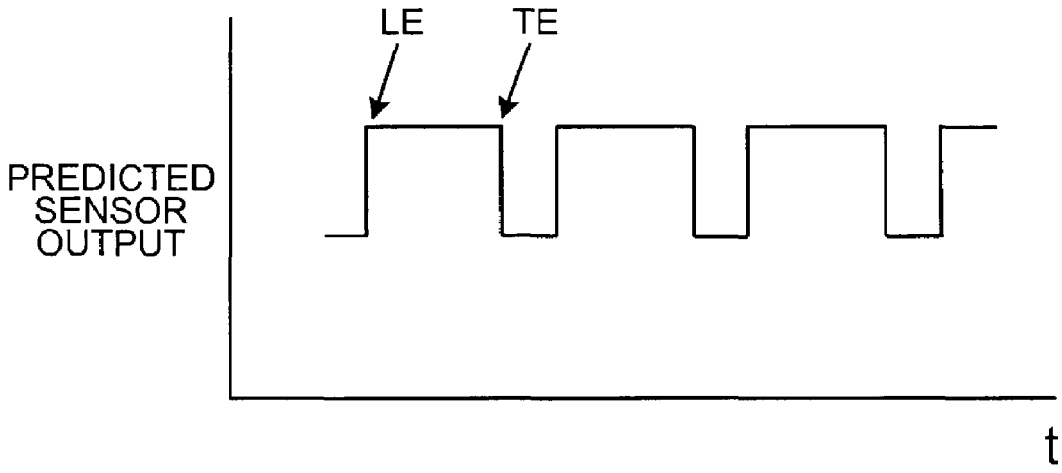
FIGS. 3*a-c* depict predicted and exemplary sensor readings in relation to the present invention.

The leading edge (LE) of documents is depicted in FIG. 3*a* as the rising edge on the wave form. This leading edge signifies the point in time when the lead edge of an insert breaks the light path between the sensor pair. The predicted timing for leading edges of consecutive inserts 3 is based on the speed of the chassis conveyor, which is geared (mechanically or electronically) to the feeding engine of the feeder 100. Thus, when an encoder for chassis 70 detects that it is at a predetermined position, and it is determined that an insert 3 is required for the corresponding mail piece, the feeder 100 will begin its release of a document.

The lead edge the insert 3 can be expected at the sensor 110 location at a calculated time shortly after the triggering of the feeder. After the feeder 100 is triggered, it may be mechanically engaged (usually via a clutch), resulting in some delay. In a preferred embodiment using a servo motor to drive the feeder, the delay after triggering may be negligible for bringing the rollers to speed. The timing of the lead edge sensor signal of an insert lead edge will also depend on whether the particular insert in the feeder 100 is required for a given mail piece. Accordingly for some cycles where no insert will be fed to the accumulation, no lead edge will be expected, and the predicted profile will reflect that accordingly.

Once the feeder 100 is engaged, the insert 3 is physically propelled at a predetermined feeder speed towards the chassis. The lead edge must travel a predetermined diagonal distance before it reaches the level of the horizontal photo-sensors 110. From the time that the feeder 100 is to be triggered, the controller 200 adds the calculated delay from engaging the feeder rollers 101 and the delay for the lead edge of the insert 3 to travel to the horizontal level of the sensors. Thus, the timing of the lead edge signal from the sensors 110 is predicted.

The controller 200 is further programmed to compare the actual arrival of the lead edge, as detected by the sensors 110, to the calculated arrival time. If the timing is off by more than a predetermined margin of error, an error signal is generated. In the preferred embodiment, the margin of error is +/−10%.

Figure 3B:
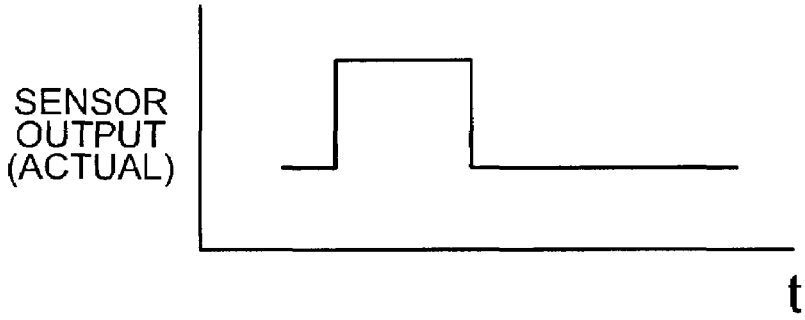

As shown in the exemplary sensor output shown in FIG. 3*b*, an expected arrival of a lead edge did not occur. In such a case, the controller 200 will provide an error signal. Such a condition as depicted in FIG. 3*b* could be the result of the feeder 100 failing to feed the insert. Alternatively, the insert may have been fed, but was somehow redirected before it could reach its prescribed position on the inserter chassis 70.

In addition to predicting the arrival of insert lead edges at the sensor locations, the controller 200 further predicts the arrival of trail edges. The arrival time of the trail edge is calculated by dividing the length of the insert by the speed of the insert feeder 100. The resulting time value is added to the lead edge arrival time, and the tail edge arrival time is predicted.

Figure 3C:
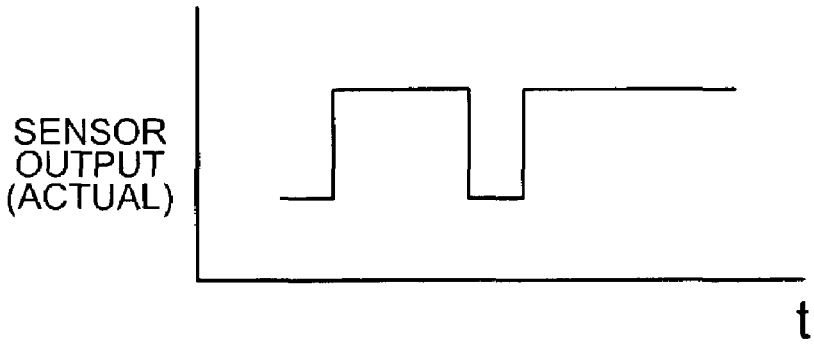

In FIGS. 3*a,* 3*b* and 3*c* the trailing edge (TE) of documents is depicted as the downward edges on the wave forms. This downward edge signifies the point in time when the trailing edge of an insert exits the light path between the sensor 110 pair. If an insert is not fed properly and lands on top of a pusher finger 73, or is bowed upward in a buckled position, then a clear path between the photo-sensor 110 pair will be blocked. An example of such a situation is depicted in FIG. 3*c*. Under those circumstances the controller 200 once again determines that the actual sensor readings are different from the predicted sensor readings and an error signal is generated.

In one embodiment of the invention, the controller 200 may distinguish between the situations depicted in FIGS. 3*b* and 3*c* and differing error signals may be provided. An error resulting from the FIG. 3*b* could result in an error signal indicating a problem with the insert failing to reach the proper collation on the chassis 70. A different error signal could be used for the situation of FIG. 3*c,* where the problem is that documents that are on the chassis 70 are out of position, and potentially jammed, or likely to create a jam.

Rather than specifically looking at lead edges and tail edges, the controller 200 can be programmed to provide an error signal upon the occurrence of any deviation from the predicted profile.

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. A document assembly system with jam detection capability comprising an accumulation chassis comprised of a series of pusher fingers for pushing consecutive collations of documents in a downstream direction, the chassis having a chassis speed in the downstream direction;

a document feeder positioned above the chassis, the document feeder controlled to release documents to the chassis to form the collations, the document feeder oriented so as to release documents in a diagonal flight path at a feeder speed, the flight path having components in the downward and downstream directions, the feeder speed being a function of chassis speed to coordinate the proper formation of collations;

a set of horizontal photo-sensors below the document feeder at a level substantially at a top region of the pusher fingers to detect lead and tail edges of documents traveling in the flight path from the document feeder to the chassis and providing signals representing the lead and tail edges; and a controller coupled to the chassis, the document feeder and the set of photo-sensors, the controller calculating an expected profile for lead and tail edge signals from the photo-sensors as a function of a position of the chassis, a length of the documents, and the speed of the document feeder, the controller comparing the expected profile with the lead and tail edge signals from the set of photo-sensors and generating an error signal when the lead and tail edge signals are different from the expected profile by greater than a predetermined margin of error.

2. The system of claim 1 wherein the error signal is a feeder jammed signal if the comparison indicates that no document lead edge has been detected by the set of photo-sensors within an expected window calculated in the expected profile.

3. The system of claim 1 wherein the error signal is a chassis jam signal if the comparison indicates that no document tail edge has been detected by the set of photo-sensors within an expected window calculated in the expected profile.

4. A method for jam detection in a document assembly system, the method comprising pushing consecutive collations of documents in a downstream direction on a document accumulation chassis at a chassis speed;

releasing documents to the chassis from a feeder above the chassis to form the collations in a diagonal flight path at a feeder speed, the flight path having components in the downward and downstream directions, the feeder speed being a function of chassis speed to coordinate the proper formation of collations;

detecting lead and tail edges of documents traveling in the flight path from the document feeder to the chassis and providing signals representing the lead and tail edges, with detection of the lead and tail edges by positioning a horizontal set of photo-sensors between the chassis and the feeder at substantially a same level as an upper portion of pusher fingers, pushing documents on the chassis by the pusher fingers;

calculating an expected profile for lead and tail edge signals as a function for position of the chassis, a length of the documents, and the speed of the document feeder;

comparing the expected profile with the lead and tail edge signals; and generating an error signal when the lead and tail edge signals are different from the expected profile by greater than a predetermined margin of error.

5. The method of claim 4 wherein step of generating the error signal includes generating a feeder jammed signal if the comparing step indicates that no document lead edge has been detected within an expected window calculated in the expected profile.

6. The method of claim 4 wherein the step of generating the error signal includes generating a chassis jam signal if the comparison indicates that no document tail edge has been detected within an expected window calculated in the expected profile.

* * * * *